US005118059A

United States Patent [19]

Mainer

[11] Patent Number: 5,118,059

[45] Date of Patent: Jun. 2, 1992

[54] SUPPORT BRACKETS

[76] Inventor: George W. Mainer, 750-222nd Pl. NE., Redmond, Wash. 98053

[21] Appl. No.: 666,332

[22] Filed: Mar. 7, 1991

[51] Int. Cl.[5] ..... A47B 96/06

[52] U.S. Cl. ..... 248/215; 47/67; 248/227; 248/304; 248/312.1; 248/314; 248/315

[58] Field of Search ..... 248/215, 214, 220.2, 248/225.2, 227, 312.1, 314, 315, 303, 304, 90, 208, 235, 239, 250, 249; 47/40, 67

[56] References Cited

U.S. PATENT DOCUMENTS

| | | | |
|---|---|---|---|
| 313,667 | 3/1885 | Hesser . | |
| 365,555 | 6/1887 | Tolman . | |
| 857,820 | 6/1907 | Mosher . | |
| 1,077,027 | 10/1913 | Austin . | |
| 2,049,593 | 8/1936 | Schabinger . | |
| 2,512,417 | 6/1950 | Cook . | |
| 2,774,562 | 12/1956 | Henry . | |
| 3,532,318 | 10/1970 | Lloyd . | |
| 3,578,282 | 5/1971 | Olsen | 248/214 |
| 3,888,452 | 6/1975 | Anderson . | |
| 3,907,118 | 9/1975 | Pelavin . | |
| 3,918,670 | 11/1975 | Doherty . | |
| 3,978,612 | 9/1976 | Young . | |
| 3,998,332 | 12/1976 | Lambertson . | |
| 4,059,248 | 11/1977 | Kuntz . | |
| 4,074,882 | 1/1978 | Anderson . | |
| 4,083,457 | 4/1978 | Dromboski . | |
| 4,098,483 | 7/1978 | Pesola et al. . | |
| 4,133,509 | 1/1979 | Kalbow et al . | |
| 4,203,175 | 5/1980 | Heine | 248/215 X |
| 4,397,438 | 8/1983 | Chapman . | |
| 4,405,109 | 9/1983 | Murdoch | 248/215 |
| 4,417,712 | 11/1983 | DeHart | 248/225.2 |
| 4,418,496 | 12/1983 | Koistinen . | |
| 4,422,610 | 12/1983 | Hunt . | |
| 4,431,154 | 2/1984 | Hamm . | |
| 4,666,115 | 5/1987 | Schiro . | |
| 4,809,941 | 3/1989 | Sheridan . | |
| 4,825,590 | 5/1989 | Cullianne . | |
| 4,971,279 | 11/1990 | George | 248/214 |

*Primary Examiner*—Ramon O. Ramirez
*Attorney, Agent, or Firm*—Hughes & Multer

[57] ABSTRACT

The specification discloses a support apparatus for suspending an article from a longitudinally extending member having at least one flattened side. The support apparatus comprises a support member and a bracket member. The support member substantially surrounds the longitudinally extending member and contains a portion which conforms to the flattened portion. The bracket member comprises two engaging projections and a holding portion. The engaging projections penetrate perforations formed in the support member and contact an underside of the longitudinally extending member. Notches may be formed on the engaging projections to lock the bracket member in to an extended position relative to the longitudinally extending position.

16 Claims, 5 Drawing Sheets

FIG. 1
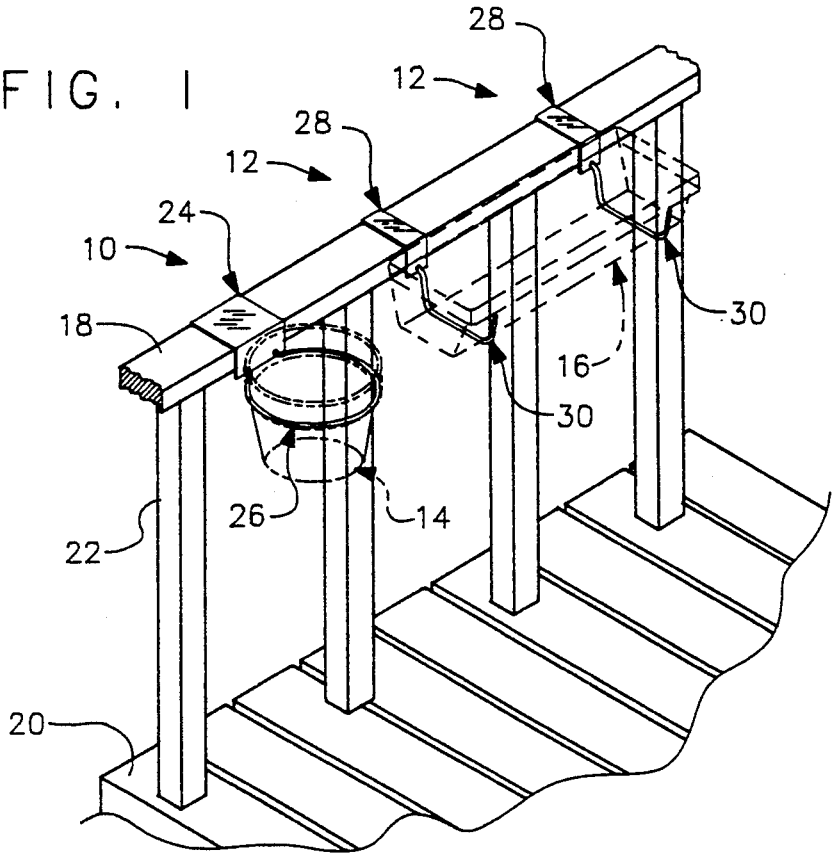
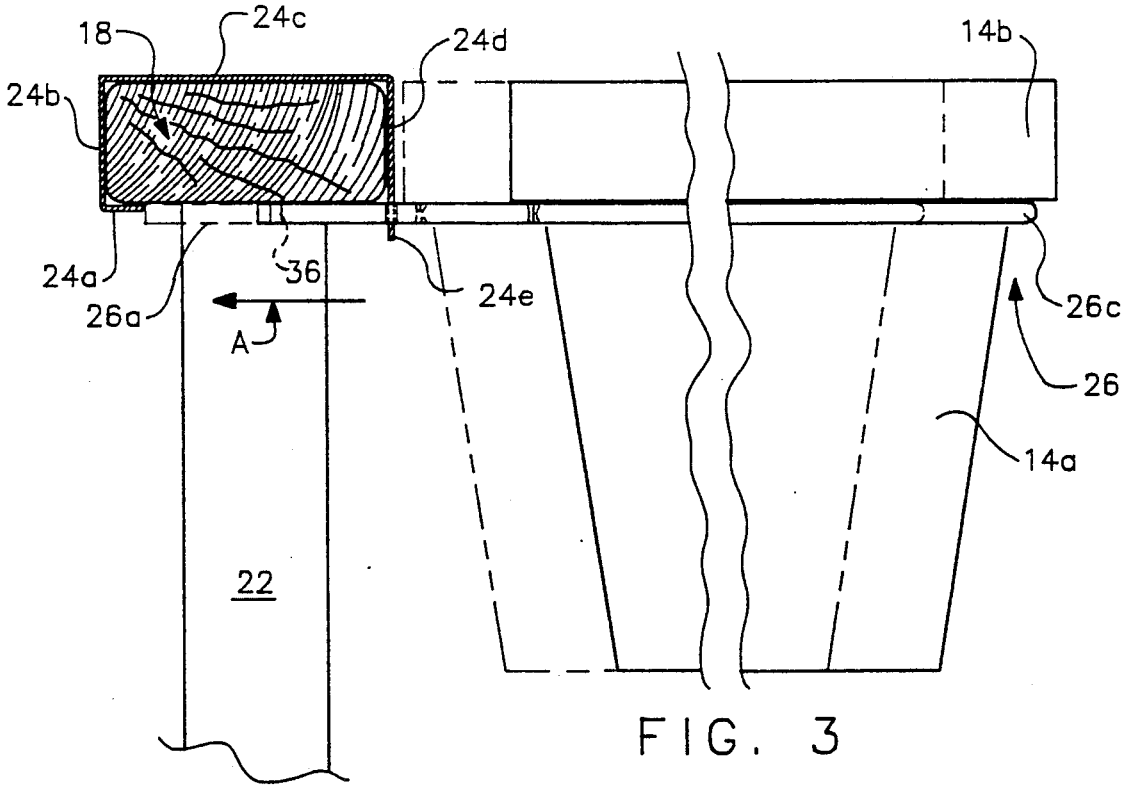
FIG. 3

10
14
18
18a
18b
18c
18d
24
24a
24b
24c
24d
24e
26
26a
26b
26c
26a'
32
34
36
38
40
42

FIG. 7
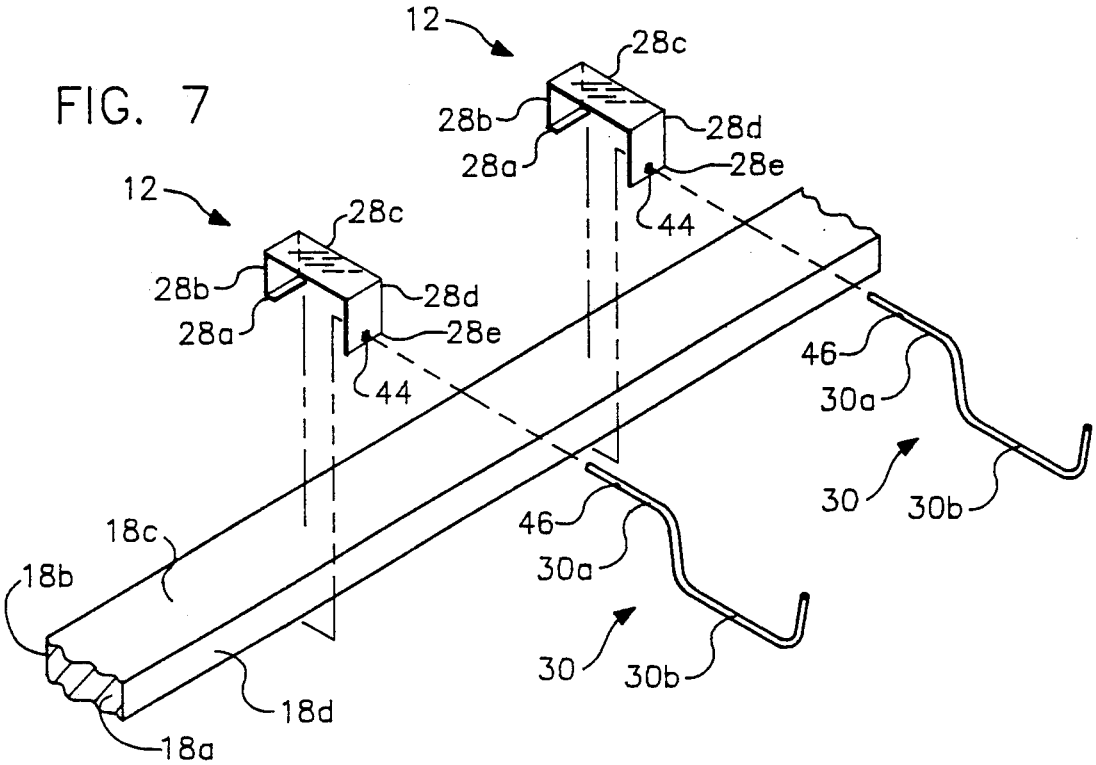
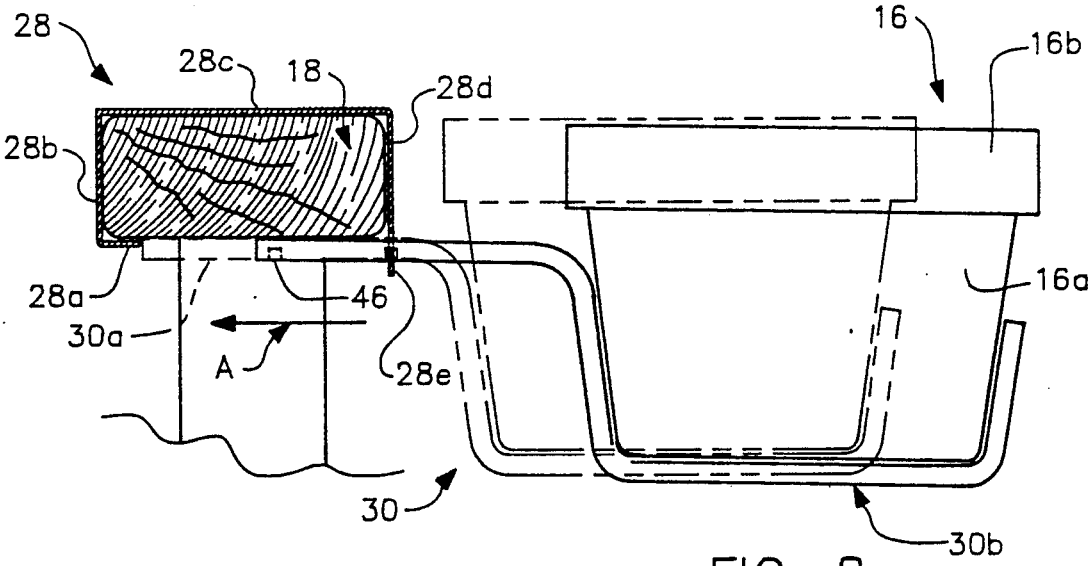
FIG. 8

SUPPORT BRACKETS

The present invention relates to novel, improved support apparatus and methods, and, more specifically, to support brackets that allow an object to be suspended from a longitudinally extending member.

A common application of the present invention is to suspend circular or rectangular planters from a horizontally arranged fence rail. In the interests of brevity and clarity, only that application will be discussed in detail herein. However, it is to be understood that this approach is not intended to limit the scope of the present invention as defined in the appended claims.

BACKGROUND OF THE INVENTION

Various devices for supporting an article have heretofore been proposed. Those of which applicant is aware are disclosed in U.S. Pat. Nos. 3,888,452 issued to Anderson on 10 Jun. 1975; 4,074,882 issued to Anderson on 21 Feb. 1978; 4,397,438 issued to Chapman on 9 Aug. 1983; 4,825,590 issued to Cullianne on 2 May 1989; 3,918,670 issued to Doherty on 11 Nov. 1975; 4,083,457 issued to Dromboski on 11 Apr. 1978; 4,431,154 issued to Hamm on 14 Feb. 1984; 4,422,610 issued to Hunt on 27 Dec. 1983; 4,133,509 issued to Kalbow et al. on 9 Jan. 1979; 4,418,496 issued to Koistenen on 6 Dec. 1983, 4,059,248 issued to Kuntz on 22 Nov. 1977; 4,098,483 issued to Pesola et al. on 4 Jul. 1978; 4,666,115 issued to Schiro on 19 May 1987; 3,978,612 issued to Young on 7 Sep. 1976, 3,907,118 issued on 23 Sep. 1975; 3,998,332 issued 21 Dec. 1976; 2,512,417 issued to Cook on 20 Jun. 1950; 1,077,027 issued to Austin on 28 October 1913; 4,809,941 issued to Sheridan on 7 Mar. 1989; 2,774,562 issued to Henry on 18 Dec. 1956, 3,532,318 issued to Lloyd on 6 Oct. 1970; 857,820 issued to Mosher on 26 Jun. 1907; 2,049,593 issued to Schabinger on 4 Aug. 1936; 365,555 issued to Tolman on 28 Jun. 1887; and 313,667 issued to Hesser on 10 Mar. 1885.

Of the above-cited references, the applicant considers the Cook, Austin, and Sheridan patents the most relevant to the patentability of the present invention. Cook allows a basketball rim to be mounted on the top or a face of a door. The device disclosed in Cook: (a) would be more expensive to produce than the present invention and (b) would not effectively suspend a bracket from a longitudinally extending member having its narrow sides vertically arranged and its wide sides horizontally arranged. The Austin patent requires that screws be screwed into the structural member from which a bracket is suspended. The present invention does not require any such permanent modification to the longitudinally extending member. The Sheridan patent requires that the longitudinally extending member have one free end around which the bracket is placed. Once the free end is fixed to another member, the bracket may not be removed from the longitudinally extending member.

SUMMARY OF THE INVENTION

The present invention basically comprises a support member which substantially surrounds a longitudinally extending member and a bracket member adapted to suspend the article. A portion of the support member is adapted to conform to a flattened surface on the longitudinally extending member. Further, perforations are formed in a perforated portion of the support member. One or more engaging projections extending from the bracket member are inserted through the perforations in the support member when the support member surrounds the longitudinally extending member. So inserted, the engaging projections contact the underside of the longitudinally extending member to firmly support the bracket member.

Optionally, notches may be formed on each engaging projection. These notches are designed to engage the perforations to define a first, extended position. In this first position, the article suspended from the bracket member is a given distance away from the longitudinally extending member. The engaging projections may be inserted further into the perforations such that the article suspended from the bracket member is in a second, back position. The article is closer to the longitudinally extended member in the second position than in the first position.

The bracket member may be formed with only one engaging member, or with as many engaging members as necessary to present a stable structure from which to suspend the article. Further, several of such support apparatus may be employed to support various sections of a larger article.

OBJECTS OF THE INVENTION

From the foregoing, it is apparent that one important object of the invention is to provide novel, improved apparatus and methods for suspending articles from a longitudinally extending member.

Other important, but more specific, objects of the present invention are to provide apparatus and methods for supporting articles from a longitudinally extending member that:

are easily and cheaply manufactured;

are easily mounted onto and removed from the longitudinally extending member;

do not mar or otherwise damage the longitudinally extending member;

do not require that permanent modifications be made to the longitudinally extending member; and may be designed to fit a wide variety and different orientations of longitudinally extending members.

BRIEF DESCRIPTION OF THE DRAWINGS

FIG. 1 is a perspective view of the first and second embodiments of the present invention;

FIG. 3 is a side, cut-away view of the first embodiment showing two positions in which the bracket may be placed;

FIG. 7 is an exploded, perspective view of the second embodiment;

FIG. 8 is a side, cut-away view of the second embodiment showing two positions in which the bracket may be placed;

DETAILED DISCUSSION OF THE INVENTION

Figures 2, 4, 5, 6:
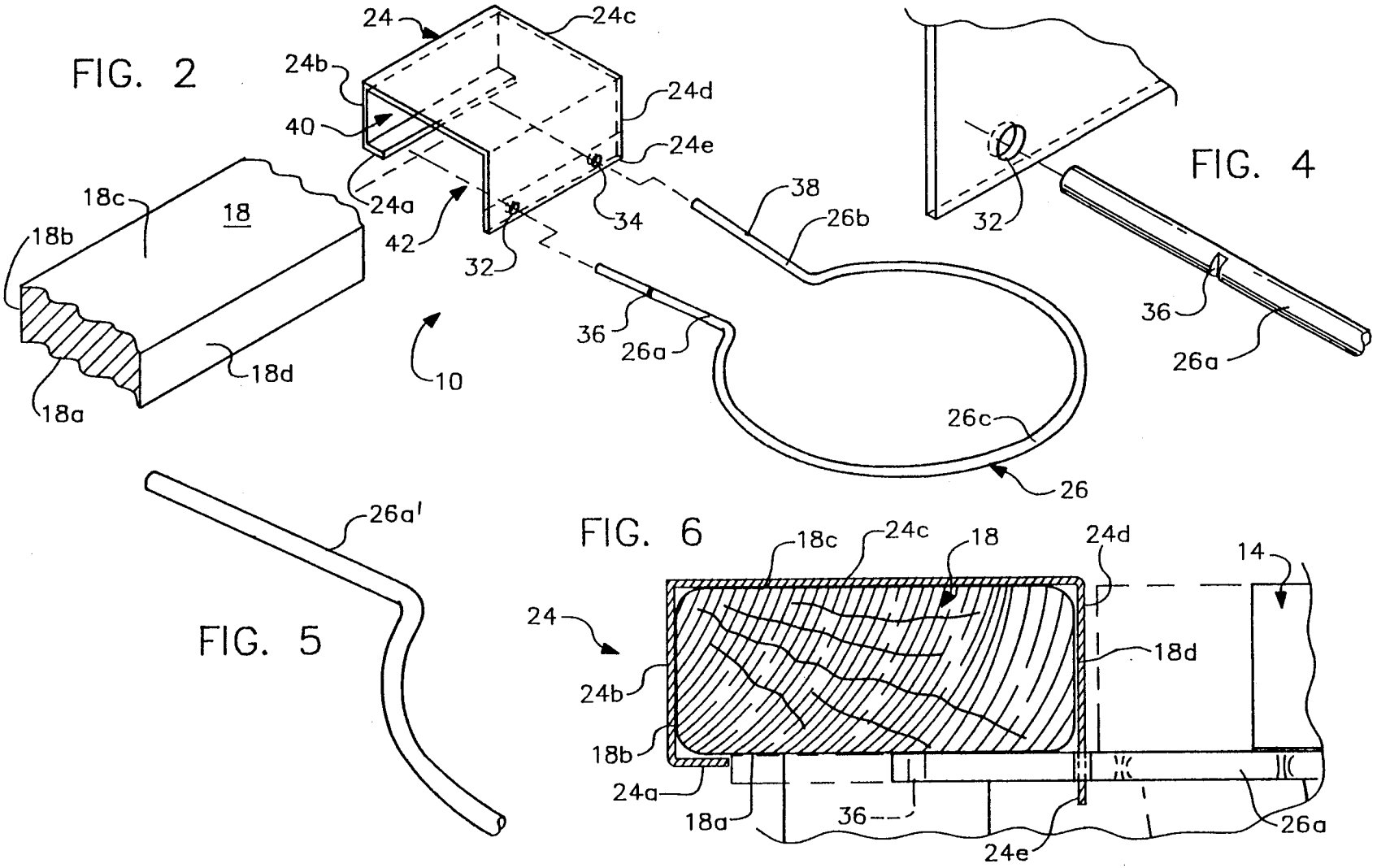
FIG. 2 is an exploded, perspective view of the first embodiment.
FIG. 4 is a detail, perspective view of an engaging projection and a perforation of the first embodiment of the present invention.
FIG. 5 is a detail, perspective view of an engaging projection of the present invention without a notch formed thereon.
FIG. 6 is a detail, side view of the first embodiment showing how the engaging projection contacts the underside of the rail.

Turning now to the drawing, FIG. 1 depicts first and second embodiments, indicated by reference characters 10 and 12, respectively, of the support bracket of the present invention. A double prong support bracket 10 is employed to suspend a circular planter 14, and two single prong support brackets 12 suspend a rectangular planter 16. The support brackets 10 and 12 suspend the planters 14 and 16 from a horizontally aligned, longitudinally extending fence rail 18. The rail 18 is supported at a fixed position above a floor or decking 20 by vertically extending fence posts 22. The bottom, back, top, and front surfaces of the rail 18, which are flat, are indicated by reference characters 18*a*, 18*b*, 18*c*, and 18*d*, respectively. This rail 18 may be a 2×4 piece of lumber with its narrower sides 18*b,d* vertically arranged and its wider sides 18*a,c* horizontally arranged.

Each of the single and double prong support brackets 10 and 12 basically comprise a support member and a bracket member. More specifically, the double prong support bracket 10 comprises a duel perforation support 24 and a generally circular bracket 26. The planter 14, which has a generally circular horizontal cross-section, is placed into and supported by the circular bracket 26.

Each single prong support bracket 12, on the other hand, comprises a single perforation support 28 and a U-shaped bracket 30. As depicted in FIG. 1, when two such single prong support brackets are spaced along the length of the rail 18, the U-shaped brackets 30 extend under and partially around each end of the generally rectangular planter 16 such that the planter 16 is supported from the rail 18. While the single prong support brackets 12 are shown in tandem in FIG. 1, only one such support bracket 12 need be used to support articles such as a coiled garden hose.

The double prong support bracket 10 of the first embodiment will now be described in detail with reference to FIGS. 2–6. In this embodiment, the dual perforation support 24 is formed from a piece of rectangular, flat metal bent at certain locations to conform to the rail 18. The gauge of the metal used is preferably 16 to 24. The dual perforation support 24 includes a bottom portion 24*a*, a first side portion 24*b*, a top portion 24*c*, a second side portion 24*d*, and a perforated portion 24*e*, which can be made simply as a downward extension of the side portions 24*d*. Each of these portions is dimensioned such that the support 24 substantially surrounds the rail 18. More specifically, the inside surfaces of back and front portions 24*b* and 24*d* have substantially the same top to bottom dimensions as the narrower sides 18*b,d* of the rail 18. Similarly, the inside surface of the top portion 24*c* has the same front to back dimension as the wider sides 18*a,c* of the rail 18. The perforated portion 24*e* is coplanar with the front portion 24*d*. This perforated portion 24*e* extends below the plane occupied by the bottom surface 18*a* of the rail 18.

The dimension of each portion of the support 24 along the length of the rail 18 is the same. This lengthwise dimension is determined based on the dimensions of the circular bracket 26 as will be discussed in detail below As can be clearly seen in FIG. 2, the circular bracket 26 comprises a first engaging projection 26*a*, a second engaging projection 26*b*, and a holding or loop portion 26*c*, with these three portions 26*a*, 26*b*, and 26*c* being integrally formed from a single piece of wire. These engaging projections 26*a,b* are coplanar and lines drawn lengthwise through these projections are slightly divergent in a rearward direction. This wire is rigid enough to suspend a heavy article such as a planter when the bracket 26 is supported only by its projections 26*a,b*, but is flexible enough to allow the projections 26*a,b* to be manually forced toward each other. When no force is applied to the projections 26*a,b*, these projections slightly diverge from each other.

In the two prong support bracket 10 of the first embodiment, two holes 32 and 34 are formed on the perforated portion 24*e*. The tops of the holes 32 and 34 are generally coplanar with the bottom surface 18*a* of the rail 18. Accordingly, the plane including the centers of these holes 32 and 34 is parallel to and slightly below the plane including the bottom surface 18*a*.

As will be discussed below, the projection 24*a,b* are inserted into the holes 32 and 34 so that the bracket 26 is supported by and extends from the support 24. Holes 32 and 34 must be far enough apart to prevent the bracket 26 from rotating about a horizontal axis perpendicular to the longitudinal axis of the rail 18. The distance between the holes 32 and 34 in turn determines the lengthwise dimension of the perforated portion 24*e* of the support 24. Because the support 24 is preferably manufactured from a rectangular piece of metal, portions 24*a,b,c,d* have the same lengthwise dimension as portion 24*e*. The dimensions of the circular bracket 26 thus determines the lengthwise dimension of the support 24.

Optionally formed on the surface of the first projection 26*a* and second projection 26*b* are notches 36 and 38, respectively (FIG. 4). These notches 36, 38, are formed on opposite sides of the projections 26*a,b*. Specifically, these notches are formed on the sides of the projections in which these projections move when they move apart. The purpose of these notches will become apparent from the following description of the assembly of the dual prong support bracket 10.

The dual prong support bracket 10 is assembled onto the rail 18 in the following manner. Initially, the back side 18*b* of the rail 18 is introduced into the interior 40 of the support 24 through a gap 42 between the bottom portion 24*a* and the perforated portion 24*e* of the support 24. This is accomplished by moving the support 24 relative to the rail 18 generally in a front direction opposite to the direction indicated by arrow "A" in FIG. 3. The back side 18*b* eventually contacts the inside surface of the back portion 24*b* of the support 24. At this point, the top portion 24*c* of the support 24 is at an angle with respect to the top side 18*c* of the rail 18. The front portion 24*d* and perforated portion 24*e* of the support 24 are then pulled forward to allow the bottom of the perforated portion 24*e* to clear the corner between the top surface 18*c* and side surface 18*d* of the rail 18. The top portion 24*c* is then pushed downward such that it is parallel to, and resides on top of, the top surface 18*c*. The support 24 thus surrounds a substantial portion of the rail 18. The support 24 is sufficiently resilient to permit this mounting operation to be accomplished.

Next, the first engaging projection 26*a* and second engaging projection 26*b* are inserted into the perforations 32 and 34. This is accomplished by applying a manual pinching force to the engaging projections 26*a,b* to move them towards each other. When these projections 26*a,b* are pressed together so that they are substantially parallel, they may easily be inserted into the perforations 32 and 34 in the back direction indicated by arrow "A". As shown in FIG. 3, the bracket 26 extends from the support 24 in either of two horizontally aligned positions. In a first, extended position represented by solid lines in FIG. 3, the groves 36 and 38 are engaged with the sides of holes 32 and 34, respectively, when the manual pinching force is removed from the engaging projection 26*a,b*. Specifically, as the engaging projections 26*a,b* are inserted through holes 32 and 34 towards the back of the support 24 and the manual pinching force is released, the engaging projections 26*a,b* tend to separate. Therefore, when the notches 36 and 38 coincide with the edges of the holes 32 and 34, the notches 36 and 38 engage with the edges of the holes 32 and 34 to prevent further movement of the bracket 26. At this point, the bracket 26 is locked in the first, extended position.

If it is desired that the bracket 26 be moved closer to the rail 18, the projections 26*a,b* may again be moved slightly toward each other to allow the notches 36 and 38 to disengage from the sides of the holes 32 and 34. The bracket 26 may then be moved further in the back direction until the ends of the projections 26*a,b* contact the bottom portion 24*a* in a second, back position, as shown by dotted lines in FIG. 3. Of course, the distance between the rail 18 and planter 14 is infinitely adjustable between the back and extended positions.

Therefore, the notches 36 and 38 serve both: (a) to identify the furthermost point that the bracket 26 may be extended without bending or marring the bottom side 18*a* of rail 18; and (b) to provide a safety locking action that prevents the bracket 26 from being inadvertently withdrawn from the holes 32 and 34 in the support 24 (FIG. 6).

In both the back and extended positions, the bracket 26 is supported by the support 24 in the following manner. When the projections 26*a,b* are inserted into the holes 32 and 34, the point where the holes contact the projections becomes a pivot point about which bracket 26 tends to rotate. However, the end portions of the projections 26*a,b* located rearwardly of the portion 24*e* contact the bottom surface 18*a* of the rail, thereby preventing rotation of the bracket 26 about this pivot point (FIG. 6).

The support 24 itself is prevented from rotating about the longitudinal axis of the rail 18 by the action of the inside surfaces the support 24 on the surfaces of sides 18*a,b,c,d* of the rail 18. More specifically, the weight of the bracket 26, and anything suspended therefrom, is borne by the support 24 at the holes 32 and 34. The bottom portion 24*a* engages the bottom side 18*a* of the rail 18 and the weight borne by holes 32 and 34 does not cause the support 24 to rotate about the longitudinal axis of the rail.

In this manner, the bracket 26 is securely supported in a plane substantially parallel to the bottom surface 18*a* of the rail. The circular planter 14, which has a generally conically shaped lower portion 44 and a generally cylindrical portion 46 whose diameter is greater than the conical portion 44, may be inserted into and supported by the bracket 26.

Turning to FIGS. 7 and 8, the single prong support brackets 12 of the second embodiment will now be discussed. The support 28 operates in basically the same manner as the support 24 of the first embodiment and will be described to the extent that it differs therefrom. The inside surfaces of a bottom portion 28*a*, back portion 28*b*, top portion 28*c*, and front portion 28*d* abut surfaces 18*a*, 18*b*, 18*c*, and 18*d* of the rail 18. A perforated portion 28*e* extends slightly below the bottom surface 18*a*.

Only one hole 44 is formed in the perforated portion 28*e*. A top edge of a hole 44 formed in the perforated portion 28*e* of each support bracket 12 is substantially coplanar with the bottom surface 18*a* of the rail 18.

The U-shaped brackets 30 comprise an engaging projection 30*a* add a holding portion 30*b*. The holding portion 30*b* is adapted to substantially conform to the bottom of the article to be held. Specifically, the rectangular planter 16 includes a lower portion 16*a* and an upper portion 16*b*. The lower portion 16*a* of rectangular planter 16 has a flat bottom with sides that slant inwardly toward the bottom. Accordingly, the holding portion 30*b* has a flat portion and two slanted portions correspond with the bottom and sides of the lower portion 16*a*.

Therefore, when two such single prong support brackets 12 are spaced at an interval less than the length of the planter 16 along the rail 18, the rectangular planter 16 may be placed within the holding portions 30*b* such that its two ends are supported thereby.

Each engaging projection 30*a* has a notch 46 formed on a bottom portion thereof. These notches 46 perform basically the same function as notches 36 on circular bracket 26 in a slightly different manner, as will be discussed below.

The assembly of the support bracket 12 onto the rail 18 will now be discussed. Each support 28 is placed around the rail 18 in the same manner as support 24 of the first embodiment. The engaging projections 46 are inserted into the perforations 44 in the back direction "A" in FIG. 8. A pivot point is formed where the lower sides of the perforations 44 contact the lower sides of the projections 30*a*. As in the first embodiment, the end of the projections 30 which protrudes through the perforations 44 contacts the bottom side 18*a* of the rail 18 to prevent rotation of the bracket 30 about this pivot point.

When the bracket 30 reaches a position indicated by solid lines in FIG. 8, the planter 16 may be locked in a first, extended position. In this extended position, the notches 46 engage with the lower sides of perforations 44. The brackets 30 are thus prevented from moving forward or backwards by the engagement of notches 46 with perforations 44.

When the notches 46 engage the perforations 44, the brackets 30 and thus the planter 16 slant slightly downwardly from the horizontal top surface 18*c* of the rail 18. This slight slanting is acceptable in the overwhelming majority of situations in which the single pronged brackets 12 will be employed and can be compensated for as necessary by appropriate placement of shims between the projection 30*a* and bottom surface 18*a*.

If it is desired that the planter 16 be placed closer to the rail 18, the brackets 30 may be lifted slightly to disengage notches 46 from the edges of holes 44 and pushed further back in the back direction indicated by arrow "A" in FIG. 8. The brackets may be moved backwards until the ends of projections 30*a* contact the bottom portion 28*a* of the support 28. When the projections 30*a* contact the bottom portions 28*a*, the bracket 30 and planter 16 are in a second, back position indicated by the dotted lines in FIG. 8.

It should be clear that the distance between the planter 16 and the rail 18 is infinitely adjustable between the back and extended positions. Again, the notches 46 function to: (a) indicate the furthest point at which the bracket 30 may be extended without the torsional forces caused by the weight of the planter 16 bending the bracket 16 or marring the bottom side 18*a* of the rail 18; and (b) provide a safety lock for preventing the bracket 30 from being inadvertently withdrawn from the perforations 44.

Figure 10:
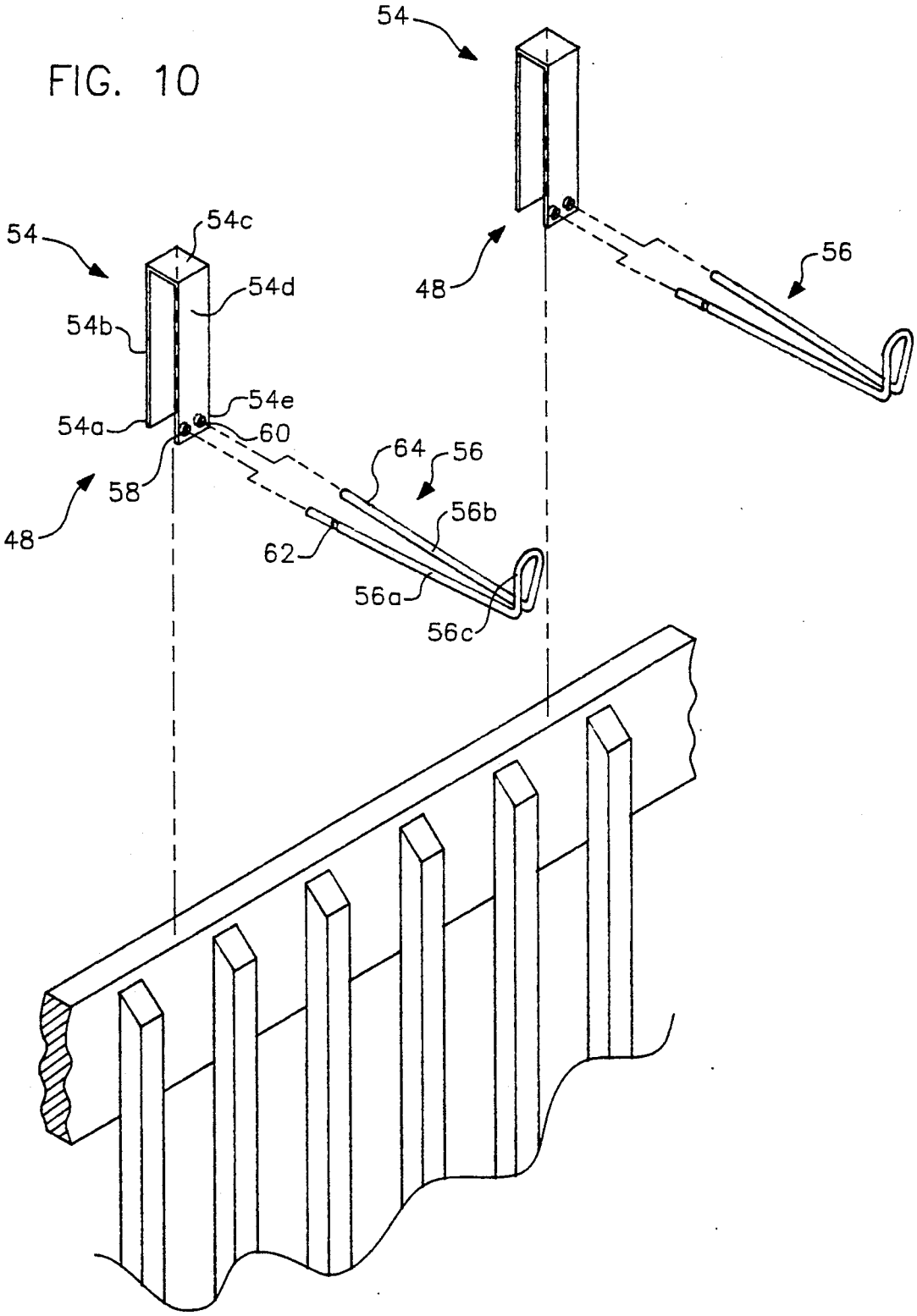
FIG. 10 is an exploded, perspective view of the first embodiment showing two positions in which the bracket may be placed.
Figure 9:
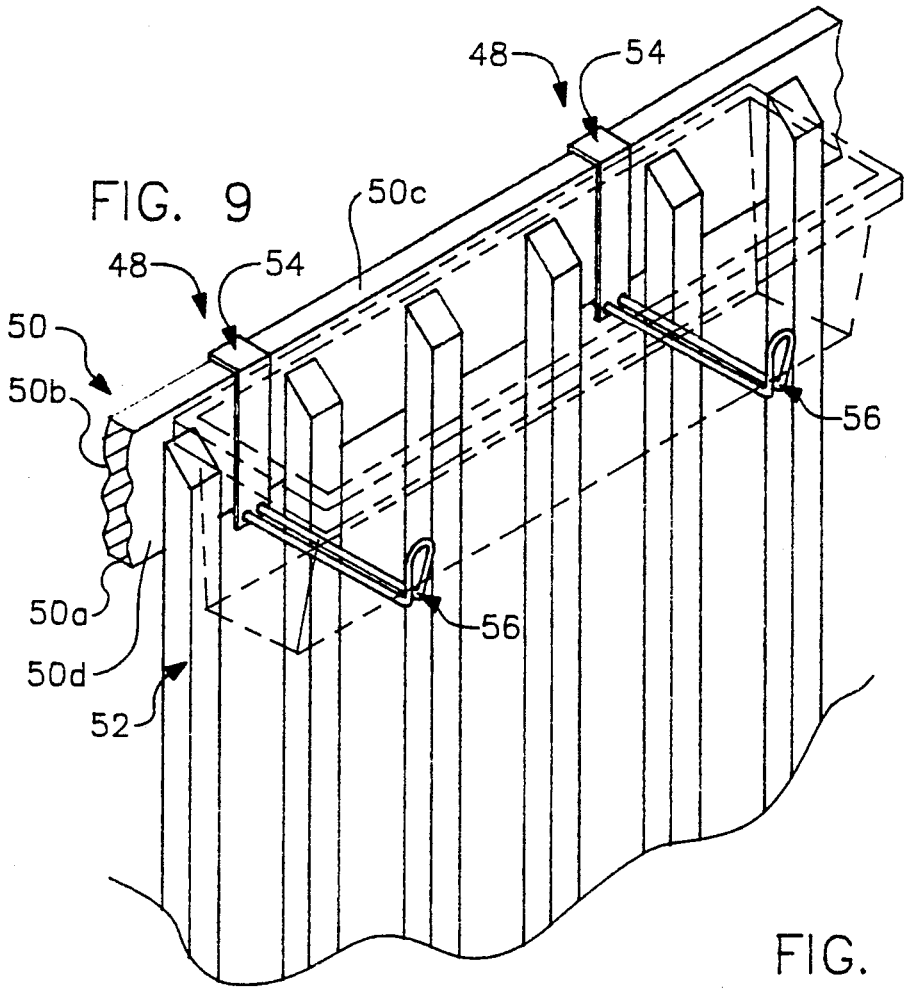
FIG. 9 is a perspective view of the third embodiment of the present invention.
Figure 11:
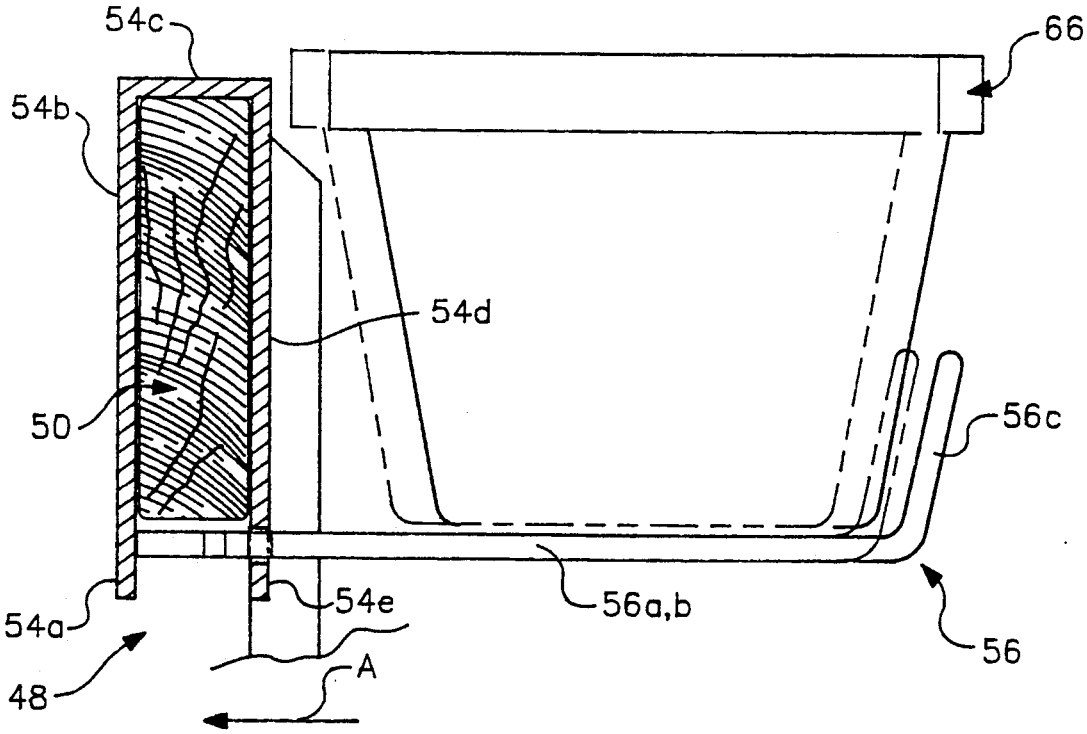
FIG. 11 is a side, cut-away view of the third embodiment showing two positions in which the bracket may be placed.

A third embodiment of the present invention will now be described with reference to FIGS. 9–11. In this embodiment, narrow dual prong support brackets 48 suspend an article from a longitudinal member that is significantly different in dimensions and arrangement from the rail 18 in the first and second embodiments. Specifically, a rail 50 may be employed. The rail 50 is a 2×6 piece of lumber arranged with its narrower sides horizontally aligned and its wider sides vertically aligned. This rail 50 is by posts 52.

The narrow dual prong support brackets 48 basically comprise a support 54 and a bracket 56. The support 54 comprises a stop portion 54*a*, a back portion 54*b*, a top portion 54*c*, a front portion 54*d*, and a perforated portion 54*e*. The stop portion 54*a* is integrally formed and coplanar with the back portion 54*b*. Similarly, the perforated portion 54*e* is integrally formed and coplanar with the front portion 54*d*. The front and back portions 54*b,d* extend at right angles from the top portion 54*c*. The support is thus generally U-shaped.

The dimensions of the support 54 are determined by the dimensions of the rail 50. More specifically, the height of the inner surfaces of the back and front portions 54*b,d* is the same as the height of the back and front surfaces 50*b,d* of the rail 50. The top portion 54*c* of the support 54, on the other hand, has the same front to back dimensions as the top portion 50*c* of the rail 50. The perforated portion 54*e* extends far enough below the bottom surface 50*a* of the rail 50 to allow perforations 58 and 60 to be formed therein at the proper location. The stop portion 54*a* should extend below the bottom surface 50*a* of the rail 50 far enough to present a surface that substantially intersects a plane containing the perforations 58 and 60. The purpose of this stop portion 54*a* will be discussed further below.

The bracket 56 comprises engaging projections 56*a,b* integrally formed with a looped portion 56*c* which upwardly extends from the engaging projections 56*a,b*. These engaging projections 56*a,b* also serve to hold an article, as will be discussed below. While the engaging projections 56*a,b* are substantially coplanar, lines drawn through these portions are slightly divergent when no forces are applied to the bracket 56.

The bracket 56 is sufficiently rigid to withstand the load of the article to be suspended therefrom, as will be discussed below, but be sufficiently resilient to allow the engaging projections 56*a,b* to be manually forced towards each other so that they are parallel. Notches 62 and 64 are formed on the engaging projections 56*a,b* a predetermined distance from the ends thereof.

To assemble the bracket 56 onto the support 54, engaging projections 56*a,b* are manually pinched together so that they are parallel. The ends of the engaging projections 56*a,b* are then inserted into the holes 58 and 60, respectively in the direction of arrow "A" in FIG. 11. As in the first embodiment, the resiliency of the bracket 56 tends to force engaging projections 56*a,b* apart when the manual pinching force is removed. Therefore, when the notches 62 and 64 coincide with the holes 58 and 60, the notches engage the sides of the holes. When the notches engage the holes, the bracket 56 is locked in its first, extended position. To insert the bracket 56 further, the engaging projections 56*a,b* are pinched slightly together to release the grooves 62 and 64 from the holes 58 and 60. The bracket 56 may then be pushed in the back direction of arrow "A" in FIG. 11 until the ends thereof contact stop portion 54*a*. The planter 66 and bracket 56 are at this point in a second back position indicated by dotted lines in FIG. 11. The position of the bracket 56 and planter 66 is infinitely adjustable between the back and extended positions.

As in the previous embodiments, the notches 62 and 64 serve the purposes of: (a) preventing bending of the bracket 56 or marring of the bottom 50*a* of the rail 50 by excessive loading on the bracket 56; and (b) inhibiting inadvertent withdrawal of the bracket 56 from the holes 58 and 60 of the support 54.

In the third embodiment, none of the inner surfaces of the various portions of the support 54 contact the bottom 50*a* of the rail 50. This is possible because the narrow surfaces of the rail 50 are horizontally aligned and the wide surfaces thereof are vertically aligned. Because of this arrangement, any tendency of the loads supported by the bracket 56 to rotate the bracket 56 around the longitudinal axis of the rail 50 is prevented by the action of the inner surfaces of back portion 54*b* and front portion 54*d* on the back surface 50*b* and front surface 50*d* of the rail 50.

Further, the inner surface of the top portion 54*c* abuts the top surface 50*c* of the rail 50 to bear the downward force caused by the planter 66 on the bracket 56.

The planter 66 is thus securely suspended from the rail 50 by the narrow dual prong support bracket 48.

It will be clear to one of ordinary skill in the art from the foregoing discussion that many modifications to the illustrative embodiments may be made without departing from the spirit or scope of the present invention. Specifically, any configuration of rail may be employed that presents a flattened surface against which an inner surface of the support can act to prevent rotation of the bracket member about the longitudinal axis of the rail. Thus, the present invention may be employed to suspend an article from any rail that is not completely circular.

Additionally, the bracket members such as brackets 24, 30, and 56 may be formed in any configuration convenient for suspending an article therefrom. Also, the notches formed on the engaging projections may be omitted, as shown in FIG. 5.

Accordingly, it is clear that the invention may be embodied in forms other than disclosed above without departing from the spirit or essential characteristics of the invention. The above-described embodiments are therefore to be considered in all respects as illustrative and not restrictive, the scope of the invention being indicating by the appended claims rather than by the foregoing description. All changes which come within the meaning and range of the equivalency of the claims are therefore intended to be embraced therein.

What is claimed is:

1. A support apparatus for suspending an article from a longitudinally extending member having upper, lower, front, and rear surfaces, said apparatus comprising:

a support member which substantially surrounds the longitudinally extending member, the support member having integral portions engageable in surface-to-surface relationship with said upper, lower, front, and rear surfaces and there being a perforation in the portion engageable with said front surface at a level such that the perforation is exposed when the support member is assembled to the longitudinally extending member; and a bracket member adapted to suspend the article, the bracket member having at least one engaging projection which can be inserted through the perforation with the support member assembled to the longitudinally extending member such that the engaging projection contacts the lower surface of the longitudinally extending member.

2. The support apparatus of claim 1, in which a notch is formed on the engaging projection, the notch being engageable by the support member to retain the support member in place when said support member is assembled to said bracket by extending its engaging portion through the perforation in the front surface engaging portion of the bracket member.

3. The support apparatus of claim 2, in which one perforation is formed in the perforated portion and the bracket member comprises a single engaging projection and a holding portion.

4. The support apparatus of claim 3, in which the notch is formed on a bottom side of the engaging projection.

5. The support apparatus of claim 4, in which two support members and two bracket members are employed to suspend the article.

6. A support apparatus for suspending an article from a longitudinally extending member having at least a first surface that is flattened, comprising:

a support member which substantially surrounds the longitudinally extending member, the support member having at least a first portion adapted to conform to the first surface and a perforated portion in which two perforations are formed; and a bracket member adapted to suspend the article, the bracket member having: (a) a holding portion, (b) a notch on said holding portion, and (c) first and second engaging projections for insertion into the two perforations of the support member, said projections being arranged in a manner that the engaging projections can be inserted through the perforations when the support member surrounds the longitudinally extending member such that the engaging projections contact the longitudinally extending member.

7. The support apparatus of claim 6, in which the two engaging projections are substantially coplanar and, when no forces are applied to the bracket member, lines drawn through the first and second engaging projections are divergent.

8. The support apparatus of claim 7, in which the notches are formed on opposite sides of the first and second engaging projections.

9. A method of supporting an article from a longitudinally extending member having a first surface that is flattened, comprising the steps of:

providing a support member having at least a first portion adapted to conform to the first surface and a perforated portion in which two perforations are formed;

providing a bracket member adapted to suspend the article, the bracket member having a holding portion, first and second engaging projections for insertion into the two perforations of the support member, and a notch on each engaging projection;

engaging the support member with the longitudinally extending member so that the support member substantially surrounds the longitudinally extending member with the first portion adjacent to the first surface;

positioning the engaging projections so that the notches coincide with the perforations; and so inserting the first and second engaging projections into the perforations that the engaging projections contact the longitudinally extending member.

10. The method of claim 9, in which two support members and two bracket members, both configured as aforesaid, are employed to suspend the article.

11. The method of claim 9, in which the two engaging projections are substantially coplanar and, when no forces are applied to the bracket member, lines drawn through the respective axes of the first and second engaging projections are divergent.

12. The method of claim 11, in which the notches are formed on opposite sides of the first and second engaging projections.

13. The method of claim 12, further comprising the step of forcing the engaging projections towards each other before they are inserted into the perforations.

14. A support apparatus for supporting a planter from a horizontally aligned rail which is rectangular in cross-section, comprising:

a support member which substantially surrounds the rail, the support member having at least one portion adapted to conform to at least one side of the rail and a perforated portion in which one or more perforations are formed; and a bracket member having one or more engaging projections and a holding portion adapted to hold the planter, notches being so formed on the engaging projections that the engaging projections can be inserted through the perforations when the support member surrounds the rail such that the engaging projections contact a bottom side of the rail;

the support member comprising at least a bottom portion for contacting the bottom side of the rail;

the bracket member having first and second engaging projections integrally formed with a loop from a piece of wire;

notches being formed on opposite sides of the engaging projections;

the planter having at least one portion circular in cross-section which is received within the loop; and the notches engaging the perforations to define a first, extending position relative to the rail, the engaging projections contacting the bottom portion of the support member to define a second, back position of the planter, and the distance from the planter to the rail being infinitely adjustable between the first and second positions.

15. The support apparatus of claim 14, in which:

the support member comprises at least a bottom portion for contacting the bottom side of the fence rail:

the bracket member comprises a single engaging projection integrally formed with a downwardly extending generally U-shaped holding portion from a piece of wire;

a notch is formed on a bottom side of the engaging projection; and the notches engage the perforations to define a first, extended position relative to the fence rail, the engaging projections contact the bottom portion of the support member to define a second, back position relative to the fence rail, and the distance from the planter to the fence rail is infinitely adjustable between the first and second positions.

16. The support apparatus of claim 14, in which the support bracket is generally U-shaped in cross-section and further comprises a stop portion;

the bracket member comprises two engaging projections and an upwardly extending looped portion integrally formed therewith from a single piece of wire;

notches are formed on opposite sides of the engaging projections; and the notches engage the perforations to define a first, extended position relative to the fence rail, the engaging projections contact the bottom portion of the support member to define a second, back position relative to the fence rail, and the distance from the planter to the fence rail is infinitely adjustable between the first and second positions.

* * * * *